US011486154B2

(12) United States Patent
Eroglu et al.

(10) Patent No.: US 11,486,154 B2
(45) Date of Patent: Nov. 1, 2022

(54) PERIMETER PROTECTION SYSTEM FOR A HORIZONTAL FORMWORK SYSTEM, AND METHOD OF ASSEMBLY OF A PERIMETER PROTECTION SYSTEM

(71) Applicant: ULMA C y E, S. Coop., Oñati (ES)

(72) Inventors: Yildray Eroglu, Wiesbaden (DE); Roberto Sobral Villanueva, Messel (DE)

(73) Assignee: ULMA C Y E, S. COOP., Oñati (ES)

( * ) Notice: Subject to any disclaimer, the term of this patent is extended or adjusted under 35 U.S.C. 154(b) by 348 days.

(21) Appl. No.: 16/751,325

(22) Filed: Jan. 24, 2020

(65) Prior Publication Data

US 2020/0240155 A1 Jul. 30, 2020

(30) Foreign Application Priority Data

Jan. 24, 2019 (EP) ..... 19382050

(51) Int. Cl.
*E04G 17/00* (2006.01)
*E04G 5/14* (2006.01)
(Continued)

(52) U.S. Cl.
CPC ..... *E04G 17/002* (2013.01); *E04G 5/14* (2013.01); *E04G 21/3204* (2013.01); *E04G 21/3247* (2013.01)

(58) Field of Classification Search
CPC ..... E04G 17/002; E04G 5/14; E04G 21/3204; E04G 2005/148; E04G 11/483
See application file for complete search history.

(56) References Cited

U.S. PATENT DOCUMENTS 4,467,888 A * 8/1984 Hickling ..... E04G 5/14 182/19
6,405,830 B1 * 6/2002 Hayman ..... E04G 7/28 182/186.7

(Continued)

FOREIGN PATENT DOCUMENTS

EP 2757212 A1 7/2014
FR 2987857 A1 * 9/2013 ..... E04G 11/36
FR 2987857 A1 9/2013

OTHER PUBLICATIONS

Search report in corresponding European Patent Application No. 19382050.3, dated Jun. 26, 2019.

*Primary Examiner* — Colleen M Chavchavadze
*Assistant Examiner* — Kathleen M. McFarland
(74) *Attorney, Agent, or Firm* — Edell, Shapiro & Finnan, LLC

(57) ABSTRACT

A perimeter protection system for protecting operators against lateral falling when installing formwork panels in a horizontal formwork system. According to one embodiment the perimeter protection system includes a perimeter protection structure configured for being fixed, in a working position, to the horizontal formwork system, and at least one auxiliary device configured for being fixed to the horizontal formwork system and for fixing the perimeter protection structure to the horizontal formwork system. The auxiliary device includes guiding means collaborating with a guide of the perimeter protection structure for positioning the perimeter protection structure in an initial assembly position. In the initial assembly position the structure is configured to be raised up to an intermediate position where it is permitted to swing until it is positioned in the working position.

10 Claims, 11 Drawing Sheets

(51) Int. Cl.
*E04G 21/32* (2006.01)
*E04G 11/48* (2006.01)

(56) References Cited

U.S. PATENT DOCUMENTS 8,262,056 B2 * 9/2012 Schwoerer ..... E04G 11/483 249/210
8,297,873 B1 * 10/2012 Schram ..... E01F 9/685 40/607.04
8,308,126 B2 * 11/2012 Arocena Begareche ..... E04G 11/50 249/28
8,714,306 B2 * 5/2014 Iturbe Beristain .. E04G 21/3247 182/138
8,833,520 B2 * 9/2014 Pizzolato ..... E02D 29/12 182/113
9,004,443 B2 * 4/2015 Zhang ..... E04G 11/486 249/18
9,945,138 B1 * 4/2018 Cahoon ..... E04G 21/3204
10,465,398 B2 * 11/2019 Herzog ..... E04G 3/28
10,533,329 B2 * 1/2020 Hayman ..... E04G 7/22
10,570,633 B2 * 2/2020 Bacon ..... E04G 25/061
10,655,346 B2 * 5/2020 White ..... E04G 17/14
10,702,724 B2 * 7/2020 Subzda ..... E04G 21/3223
10,711,472 B2 * 7/2020 Bond ..... E04G 11/38
10,995,503 B2 * 5/2021 Hayman ..... E04G 5/145
11,047,142 B1 * 6/2021 Bond ..... E04G 11/38
11,149,434 B2 * 10/2021 Baron ..... E04G 11/48
11,332,947 B2 * 5/2022 Hayman ..... E04G 7/308
2013/0001493 A1 * 1/2013 Svedberg ..... E04G 21/3233 52/745.11
2014/0345229 A1 * 11/2014 Grumberg ..... E04G 3/30 52/745.05
2014/0361144 A1 * 12/2014 McGahan ..... E04G 11/10 249/47
2014/0367628 A1 * 12/2014 Hewson ..... E04G 5/142 256/65.14
2020/0299978 A1 * 9/2020 Haeberle ..... E04G 5/14
2020/0332540 A1 * 10/2020 Schneider ..... E04G 21/3204
2021/0189759 A1 * 6/2021 Rainville ..... E04G 21/3233
2021/0198911 A1 * 7/2021 Read ..... E04G 11/48
2022/0220753 A1 * 7/2022 Araujo ..... E04G 11/483
2022/0235567 A1 * 7/2022 Stephan ..... A62B 35/0075

* cited by examiner

PERIMETER PROTECTION SYSTEM FOR A HORIZONTAL FORMWORK SYSTEM, AND METHOD OF ASSEMBLY OF A PERIMETER PROTECTION SYSTEM

CROSS-REFERENCE TO RELATED APPLICATIONS

This application is related to and claims the benefit and priority to European Application No. EP19382050.3, filed Jan. 24, 2019.

TECHNICAL FIELD

The present invention relates to perimeter protection systems for protecting operators against lateral falling when installing formwork panels in horizontal formwork systems, and to a method of assembly of a perimeter protection system in a horizontal formwork system.

BACKGROUND

Horizontal formwork systems and perimeter protection systems for said horizontal formworks so that operators do not fall over the sides of the horizontal formwork system while working on said horizontal formworks are known. Horizontal formwork systems generally comprise longitudinal beams, cross beams, formwork panels which are arranged on the longitudinal and/or cross beams, and vertical props or supports which support the horizontal beams, cross beams, and formwork panels at a given height above the ground. Perimeter protection systems are fixed to formwork systems, being arranged like a railing, such that they protect operators against falls when working on formwork panels.

International Publication No. WO 2017178459 A1 describes an anti-fall side protection system comprising a panel with at least two longitudinal supports connected by transverse elements, and at least two posts which are fixed to the formwork beams through detachable anchors, with the panel being arranged fixed to the posts. In this case, the operator first fixes the posts to the formwork beams and then fixes the corresponding panel to the corresponding post, so in order to carry out this operation, the operator must be located on the formwork panels.

Canadian Publication No. CA 2020201 A1 describes a side protection comprising a pivoting structure and a railing coupled to the pivoting structure. The pivoting structure is arranged below the formwork structure, and it is connected with said formwork structure and can pivot with respect to a first axis between an installation position and a final position. The pivoting structure has a base that is pivotable with respect to the first axis and an extension in turn connected to the base in a pivotable manner with respect to a second axis.

European Publication No. EP 2757212 A1 describes a side protection system for horizontal formwork systems which is assembled from below to assure operator safety. To that end, the protection system comprises a railing-like side protection structure, an extendable support which is arranged below the formwork structure and the free end of which pivots below said structure until being parallel to it in the final assembly position, whereas the other end, in which the perimeter protection structure is assembled, is anchored to the formwork structure.

SUMMARY

Disclosed is a perimeter protection system and a method of assembly of a perimeter protection system in a horizontal formwork system.

One aspect of the invention relates to a perimeter protection system for protecting operators against lateral falling when installing formwork panels in a horizontal formwork system. The perimeter protection system comprises at least one perimeter protection structure configured for being fixed, in a working position, to the horizontal formwork system, and at least one auxiliary device configured for being fixed to the horizontal formwork system and for fixing the perimeter protection structure to the horizontal formwork system.

The auxiliary device comprises guiding means collaborating with a guide of the perimeter protection structure for positioning the perimeter protection structure in an initial assembly position, raising the perimeter protection structure up to an intermediate position, and swinging said perimeter protection structure until positioning it in the working position.

Another aspect of the invention relates to the method of assembly of a perimeter protection system in a horizontal formwork system such as the one described above, the perimeter protection system comprising a perimeter protection structure and at least one auxiliary device. The method comprises the following steps:

- fixing the auxiliary device corresponding to the horizontal formwork system,
- positioning the perimeter protection structure with respect to the corresponding auxiliary device in an initial assembly position, coupling guiding means of the auxiliary device with a guide of the perimeter protection structure,
- raising the perimeter protection structure up to an intermediate position, with the movement of the perimeter protection structure with respect to the auxiliary device being guided by means of the cooperation of the guide with the guiding means,
- swinging the perimeter protection structure with respect to the auxiliary device until positioning it in the working position, and
- blocking the perimeter protection structure in the working position through blocking means.

The perimeter protection system obtained is a safe system that is optimized as regards the number of parts and in that it is easily assembled. Furthermore, this perimeter protection system is assembled quickly and safely for the operator. The operator assembles it from the ground and not from the formwork panels, such that when the operator starts to work on the formwork panels, the sides are protected with the perimeter protection system. Accidents are thereby prevented during the assembly of side protection systems.

These and other advantages and features will become apparent in view of the drawings and detailed description.

DETAILED DESCRIPTION

Figure 1:
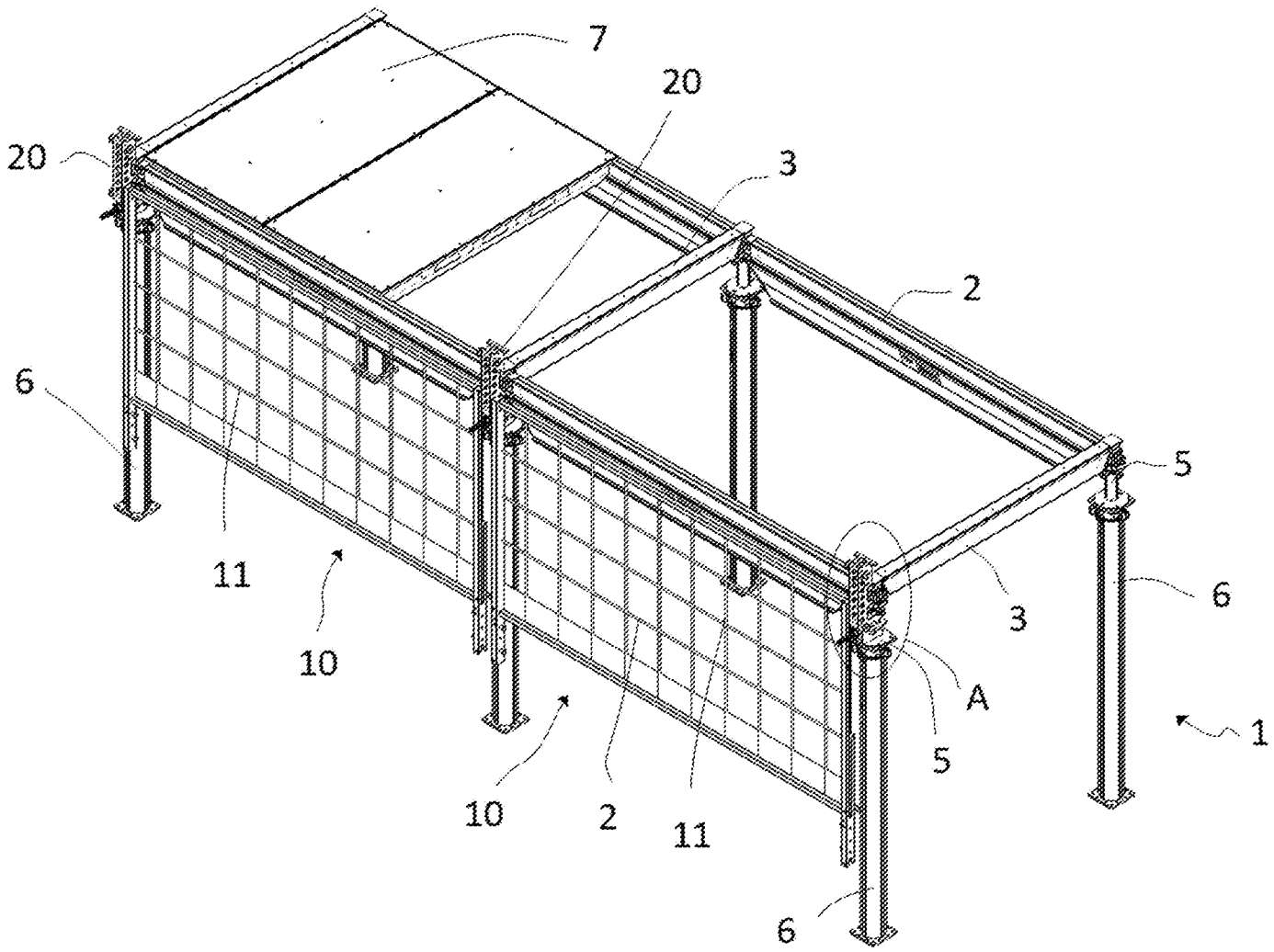
FIG. 1 shows a perspective view of an embodiment of a perimeter protection system according to the invention once assembled, in an initial assembly position, in a horizontal formwork system.

FIGS. 1, 4, 7 and 16 show a horizontal formwork system 1; 1' comprising longitudinal beams 2, cross beams 3, and props 6 which support cross beams 3 and longitudinal beams 2, said props 6 being supported on the ground. The horizontal formwork system 1; 1' further comprises heads 5, each of which is arranged fixed to the corresponding prop 6, with the ends of the cross beams 3 and longitudinal beams 2 in turn being arranged coupled to the corresponding head 5, such that the longitudinal beams 2 and cross beams 3 are arranged coupled to the corresponding prop 6 through the corresponding head 5.

The horizontal formwork system 1; 1' also comprises formwork panels 7 which are arranged supported on the longitudinal beams 2. The formwork panels 7 could also be arranged only on the cross beams 3 or on both longitudinal beams 2 and cross beams 3. Furthermore, in other embodiments not shown in the drawings, instead of props 6, the horizontal formwork system 1; 1' may comprise scaffolds, centerings, or other structures which support the formwork panels 7, longitudinal beams 2, and cross beams 3 at a given height.

To prevent falls over the sides of the horizontal formwork system 1; 1', said horizontal formwork system 1; 1' comprises a perimeter protection system 10 which protects operators when they are installing formwork panels 7 and in later jobs. The perimeter protection system 10 comprises a perimeter protection structure 11 configured for being fixed, in a working position, to the horizontal formwork system 1; 1', and at least one auxiliary device 20 configured for being fixed to the horizontal formwork system 1; 1' and for fixing the perimeter protection structure 11 to the horizontal formwork system 1; 1'.

In the embodiment shown in the drawings, the perimeter protection system 10 comprises two auxiliary devices 20 configured for fixing the perimeter protection structure 11 to the horizontal formwork system 1; 1', the perimeter protection structure 11 being arranged between both auxiliary devices 20. Each auxiliary device 20 is arranged fixed to the horizontal formwork system 1; 1'.

In particular, in a first embodiment shown in FIGS. 1 to 15, each auxiliary device 20 is arranged fixed to the corresponding head 5 of the horizontal formwork system 1; 1'. To that end, the perimeter protection system 10 comprises fixing means 27 comprising an anchoring hook 28 which is fixed to the head 5 and goes through the auxiliary device 20, and a nut 29. The anchoring hook 28 has a first part **28*a* hook-shaped which is configured for surrounding the head 5 and a second threaded part 28*b* going through the auxiliary device 20, particularly a body 30 of the auxiliary device 20. The nut 29 collaborates with the second part 28*b* for fixing the auxiliary device 20 to the head 5, said nut 29 being screwed on the second part 28*b* of the anchoring hook 28 until it abuts against the body 30 of the auxiliary device 20. Furthermore, the fixing means 27 comprise a flange 31 on the body 30 configured for being at least partially housed in a cavity 5*b* of the head 5, said flange 31 being retained in said cavity 5*b***.

Figure 16:
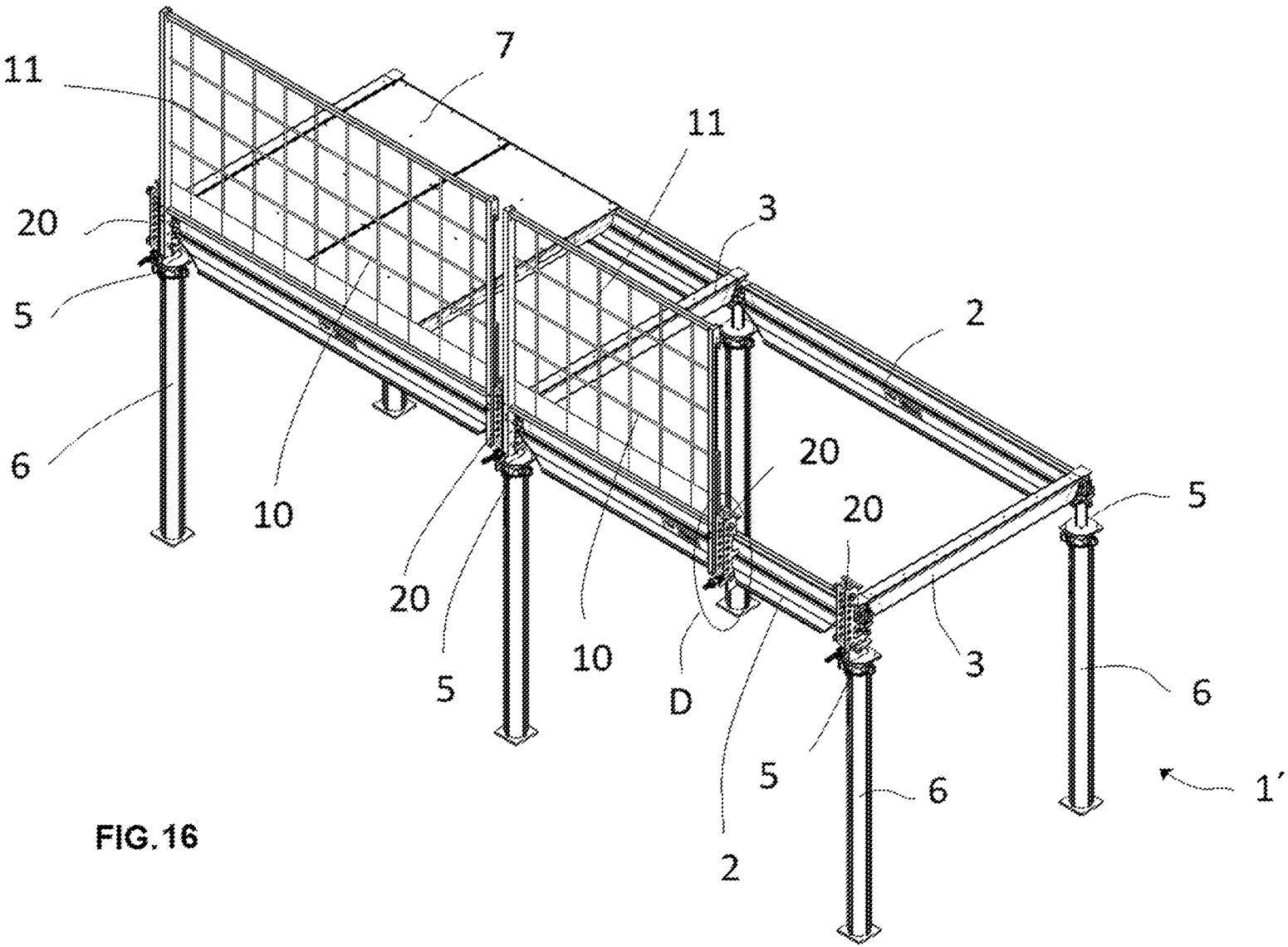
FIG. 16 shows a perspective view of a second embodiment of the perimeter protection system according to the invention assembled in a vertical formwork system.
Figure 17:
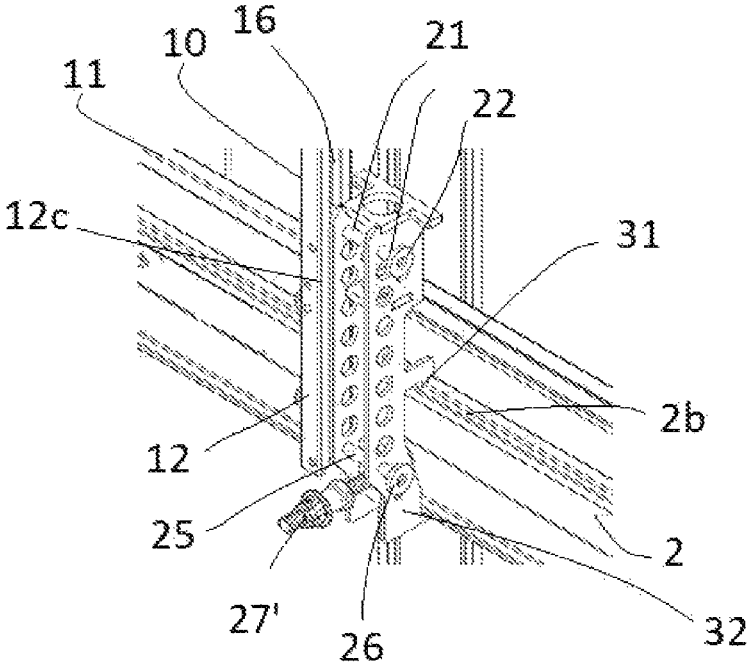
FIG. 17 shows detail D of the perimeter protection system shown in FIG. 16.
Figure 18:
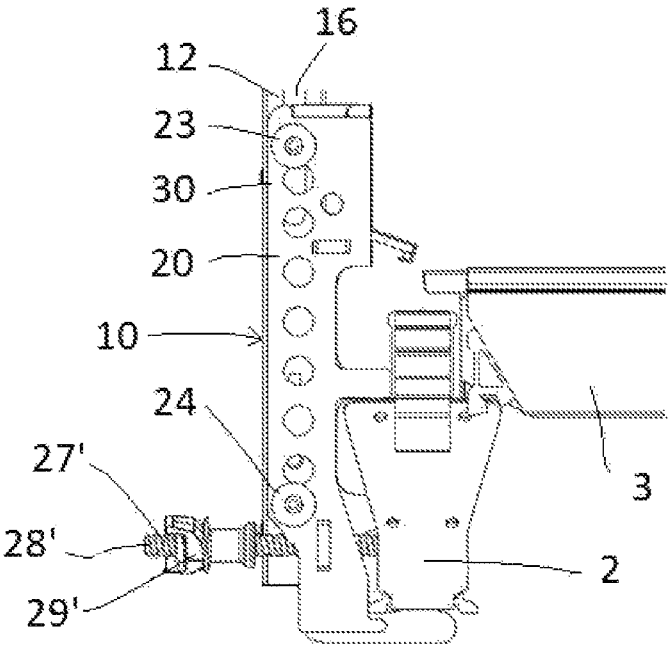
FIG. 18 shows a side view of a detail of the perimeter protection system shown in FIG. 16.

In a second embodiment shown in FIGS. 16 to 18, one of the auxiliary devices 20 is arranged fixed to a head 5 and the other auxiliary device 20 is arranged fixed to the longitudinal beam 2. For fixing the device 20 to the longitudinal beam 2, the fixing means 27' comprise a threaded element 28' going through the auxiliary device 20, particularly the body 30, and a nut 29'. The threaded element 28' has a cylindrical geometry and abuts against the beam 2, the nut 29' being screwed on until it abuts against the body 30 for fixing the auxiliary device 20 to the beam 2. The fixing means 27' also comprise the flange 31 in the body 30 configured for being at least partially housed in a housing **2*b* of the longitudinal beam 2, the flange 31 being retained in said housing 2*b***.

The embodiments shown in the drawings differ from one another by the fixing means, with the remaining features of the perimeter protection system being common to both embodiments.

The perimeter protection structure 11 is configured for acting as a railing, protecting the sides of the horizontal formwork system 1; 1'. The perimeter protection structure 11, shown in detail in FIGS. 11 to 13, preferably comprises a wire mesh 14 and two profiles 12 on which the mesh 14 is supported and which are arranged substantially vertical when the perimeter protection system 10 is fixed to the horizontal formwork system 1; 1' in the working position. The perimeter protection structure 11 further comprises stiffening elements 13 which are arranged transverse to the profiles 12 and have the purpose of stiffening the perimeter protection structure 11, and a toe plate 15. The toe plate 15 comprises a skirting **15*b* which projects with respect to the mesh 14. In other embodiments not shown in the drawings, the perimeter protection structure 11 may comprise sheets or plates instead of the mesh, or even a plurality of stiffening elements arranged parallel or orthogonal to the profiles 12**.

Figure 7:
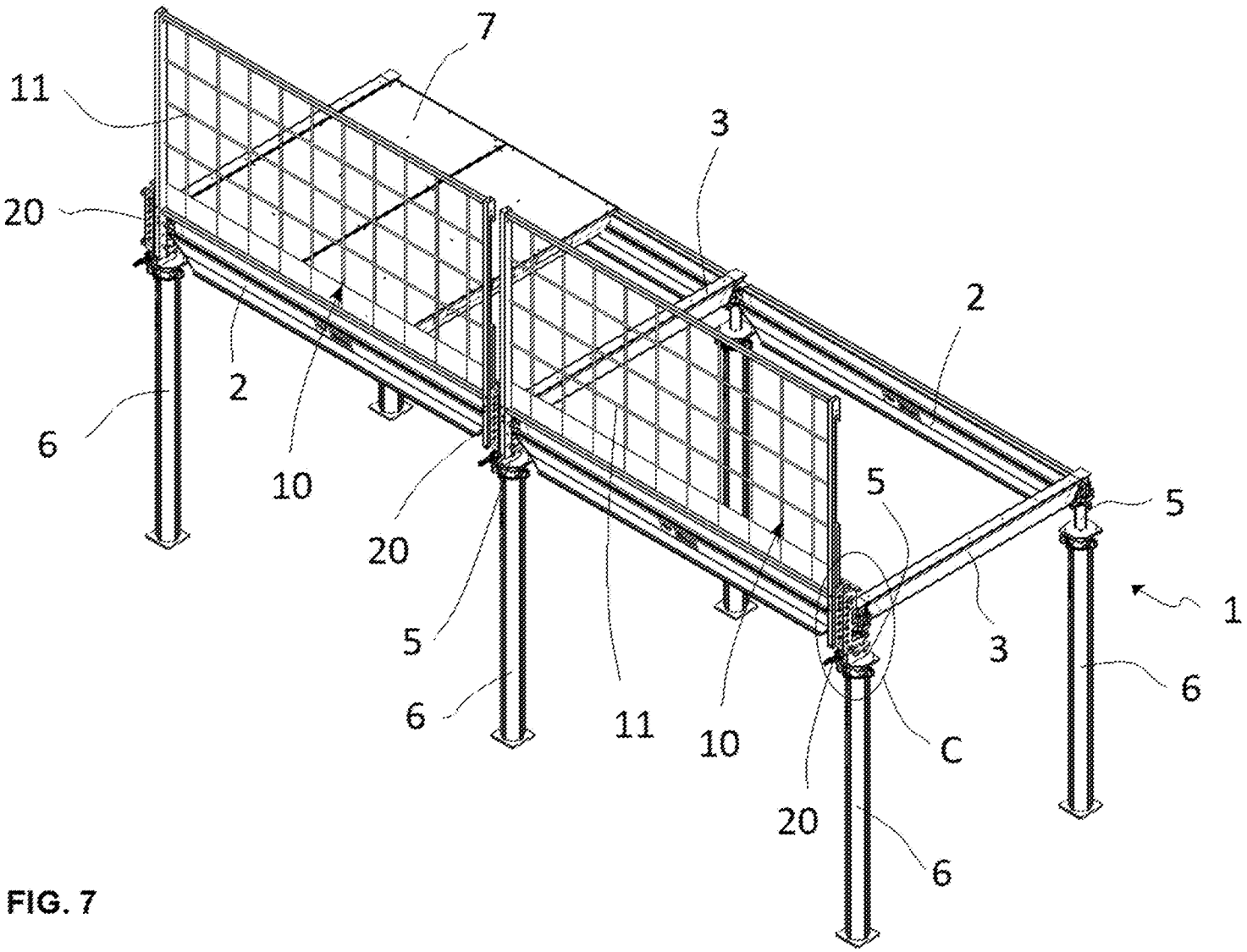
FIG. 7 shows a perspective view of the perimeter protection system shown in FIG. 1, in a final assembly position.
Figure 14:
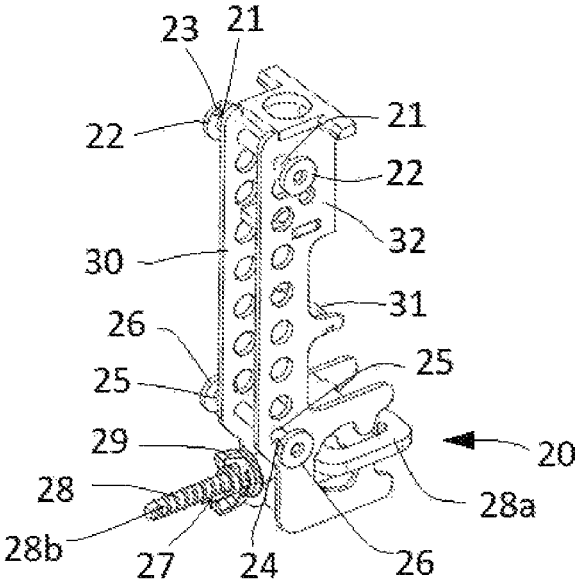
FIG. 14 shows a perspective view of an auxiliary device comprised in the perimeter protection system shown in FIG. 1.
Figure 15:
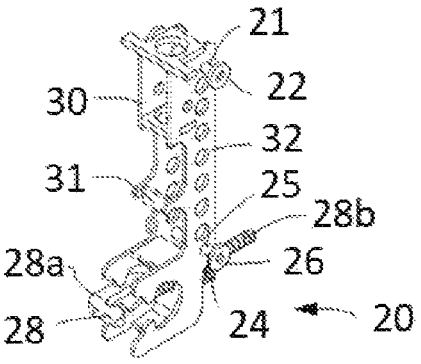
FIG. 15 shows another perspective view of the auxiliary device comprised in the perimeter protection system shown in FIG. 1.

The auxiliary device 20, shown in detail in FIGS. 14 and 15, comprises guiding means 23 collaborating with a guide 16 of the perimeter protection structure 11 for positioning the perimeter protection structure 11 in an initial assembly position (shown in FIG. 1), raising the perimeter protection structure 11 up to an intermediate position and swinging said perimeter protection structure 11 until positioning it in the working position (shown in FIGS. 7 and 16).

The guide 16 of the perimeter protection structure 11 is a groove extending longitudinally in each profile 12 of the perimeter protection structure 11, particularly on a side surface 12*c* of each profile 12. The guiding means 23 in turn comprise at least one projection 21 extending substantially orthogonal to the body 30 of the auxiliary device 20. The projection 21 is configured for going through the guide 16 and cooperating in the guided movement of the perimeter protection structure 11 with respect to the auxiliary device 20.

Once the auxiliary device 20 has been fixed to the horizontal formwork system 1; 1', the projection 21 of said auxiliary device 20 is arranged substantially horizontal. On the other hand, the projection 21 comprises a retaining element 22 configured for abutting against the side surface 12*c* of the profile 12 once said projection 21 has gone through the guide 16. Furthermore, each profile 12, which is hollow, includes an opening 17 which communicates a front surface 12*d* of said profile 12 with a part of the guide 16, see FIGS. 12 and 13. It thereby allows the projection 21 of the auxiliary device 20 to go through the guide 16, with the retaining element 22 being housed inside the profile 12, such that as the perimeter protection structure 11 is raised with respect to the respective auxiliary devices 20 to the intermediate position, the retaining element 22 prevents the removal of the perimeter protection structure 11 with respect to the corresponding auxiliary device 20.

In the embodiments shown in the drawings, the projection 21 has a substantially cylindrical geometry. In turn, the retaining element 22 arranged at one end of the projection 21 has a disc-shaped geometry.

In the embodiments shown in the drawings, each auxiliary device 20 includes two projections 21 extending in opposite directions from side surfaces 32 of the body 30 such that two perimeter protection structures 11 can be coupled in each auxiliary device 20.

On the other hand, each auxiliary device 20 comprises blocking means 24 collaborating with a blocking groove 18 comprised in the perimeter protection structure 11, particularly at an end of the corresponding profile 12, blocking the movement and rotation of the perimeter protection structure 11 with respect to the auxiliary devices 20 in the working position. The blocking means 24 comprise a blocking projection 25 configured for going through the blocking groove 18 included in the perimeter protection structure 11 and blocking the sliding of the perimeter protection structure 11 with respect to the auxiliary device 20 when the blocking projection 25 abuts against an end 18*b* of the blocking groove 18. The other end 18*a* of the blocking groove 18 is open to allow the blocking projection 25 to go through said blocking groove 18.

The blocking projection 25 comprises a retaining element 26 configured for abutting against the side surface 12*c* of the profile 12 once said blocking projection 25 has gone through the blocking groove 18, with the retaining element 26 being housed inside the profile 12 such that in the working position, the retaining element 26 of the blocking projection 26 prevents the removal of the perimeter protection structure 11 with respect to the corresponding auxiliary device 20 in a transverse direction.

In the embodiment shown in the drawings, each auxiliary device 20 includes two blocking projections 25 extending in opposite directions from the side surfaces 32 of the body 30, being configured for blocking, in the working position, two perimeter protection structures 10 for every auxiliary device 20.

In the embodiments shown in the drawings, the blocking projection 25 has a substantially cylindrical geometry. In turn, the retaining element 26 arranged at one end of the blocking projection 25 has a disc-shaped geometry.

On the other hand, the guiding projection 21 of the guiding means 23 and the blocking projection 25 of the blocking means 24, both comprised in the auxiliary device 20, are arranged substantially parallel to one another. The guide 16 and the blocking groove 18 are arranged substantially aligned with one another.

Another aspect relates to a method of assembly of the perimeter protection system 10 described previously in the horizontal formwork system 1; 1', comprising the following steps:

- fixing the corresponding auxiliary device 20 to the horizontal formwork system 1; 1',
- positioning the perimeter protection structure 11 with respect to the corresponding auxiliary device 20 in an initial assembly position shown in FIG. 1, coupling guiding means 23 of the auxiliary device 20 with a guide 16 of the perimeter protection structure 11,
- raising the perimeter protection structure 11 up to an intermediate position, with being the movement of the perimeter protection structure 11 with respect to the auxiliary device 20 guided by means of the cooperation of the guide 16 with the guiding means 23,
- swinging the perimeter protection structure 11 with respect to the auxiliary device 20 until positioning it substantially vertical, and
- blocking the perimeter protection structure 11 in the working position shown in FIGS. 7 and 16 through blocking means 24.

In the embodiments shown in the drawings, two auxiliary devices 20 are fixed to the horizontal formwork system 1; 1', with the perimeter protection structure 11 being positioned between both auxiliary devices 20, coupled to both auxiliary devices 20 in the initial assembly position shown in FIG. 1.

In the embodiment shown in FIGS. 1 to 13, each auxiliary device 20 is fixed to a head 5 through the corresponding fixing means 27. On one hand, the flange 31 of the body 30 of the auxiliary device 20 is housed in the cavity 5*b* of the corresponding head 5, retaining the flange 31 against the head 5. On the other hand, the anchoring hook 28 of the fixing device 27 going through the body 30 of the auxiliary device 20 surrounds the head 5 and the nut 29 is screwed on to the anchoring hook 28 until it abuts against the auxiliary device 20, thereby fixing the auxiliary device 20 to the head 5.

In the embodiment shown in FIGS. 16 to 18, auxiliary devices 20 are fixed to the respective head 5 like in the embodiment shown in FIGS. 1 to 13 and described above, and an auxiliary device 20 is fixed to a longitudinal beam 2 through the corresponding fixing means 27'. On one hand, the flange 31 of the body 30 of the auxiliary device 20 is housed in the housing 2*b* of the longitudinal beam 2 corresponding, retaining the flange 31 against the longitudinal beam 2. On the other hand, the threaded element 28' of the fixing device 27' goes through the body 30 of the auxiliary device 20 until abutting against the longitudinal beam 2, with the nut 29' being screwed on until it abuts against the auxiliary device 20, particularly against the body 30, thereby fixing the auxiliary device 20 to the longitudinal beam 2.

For positioning the perimeter protection structure 11 in the initial assembly position, the operator positions the perimeter protection structure 11 such that the projection 21 together with the respective retaining element 22 of the respective auxiliary device 20 go through the corresponding profile 12 through the opening 17 included in the profile 12, with the retaining element 22 being housed inside the profile 12.

Figure 2:
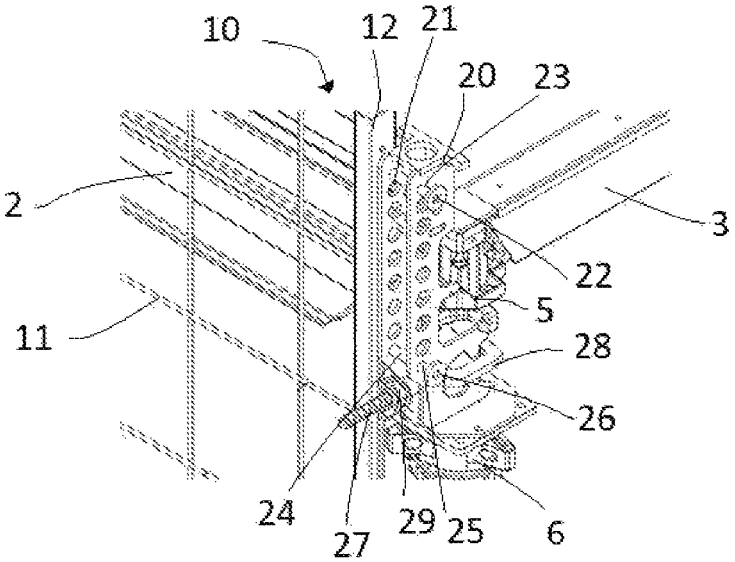
FIG. 2 shows detail A of the perimeter protection system shown in FIG. 1.
Figure 3:
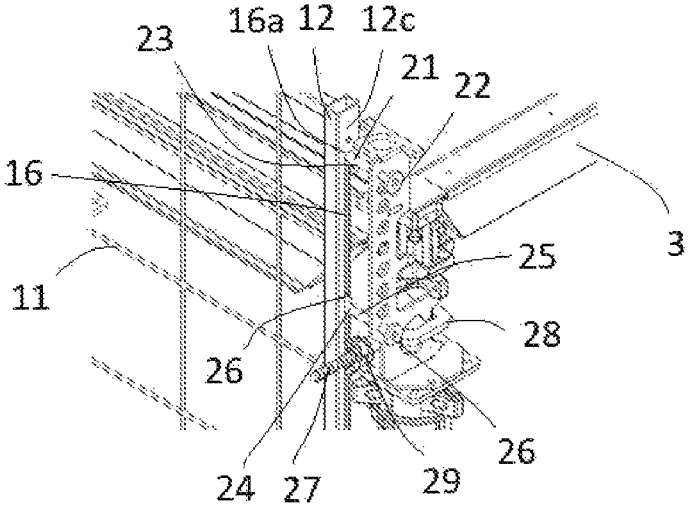
FIG. 3 shows the protection system shown in FIG. 2 in which some parts have been eliminated to favor understanding.

In the initial assembly position shown in FIGS. 1 to 3, the perimeter protection structure 11 is arranged substantially vertical, with the guiding means 23 of the respective auxiliary device 20 being arranged coupled with the respective guide 16 of the perimeter protection structure 11 such that the projections 21 of the guiding means 23 abut against an end 16*a* of the respective guide 16, as can be seen in FIG. 3, in which part of the body 30 has been eliminated for the purpose of making it easier to see. The perimeter protection structure 11 is positioned in the initial assembly position from the ground, not from the formwork panels 7. In other words, the operator assembles the perimeter protection structure 11 while standing on the ground, and not while on the formwork panels.

Figure 4:
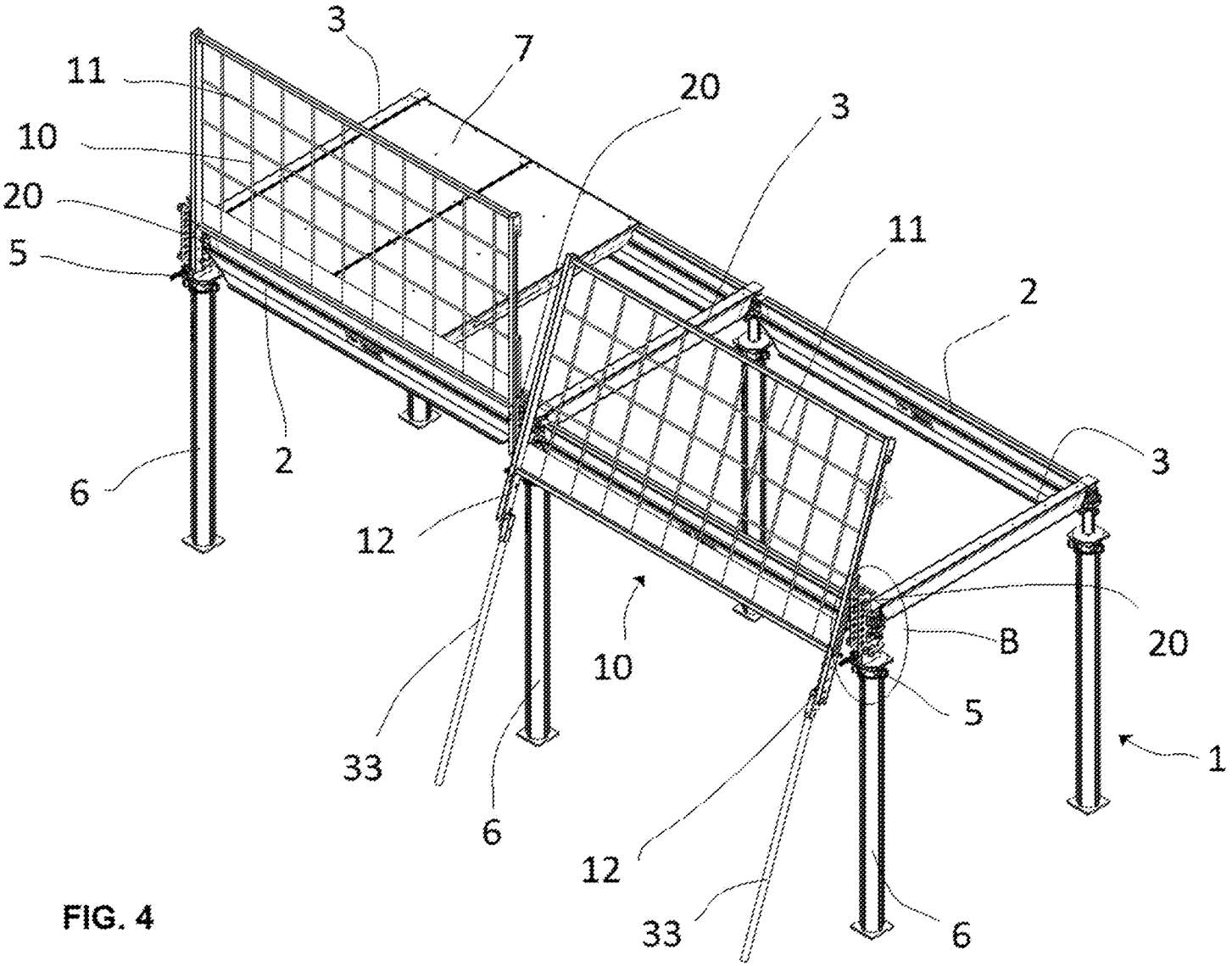
FIG. 4 shows a perspective view of the perimeter protection system shown in FIG. 1, in a position between the initial assembly position and a working position.
Figure 5:
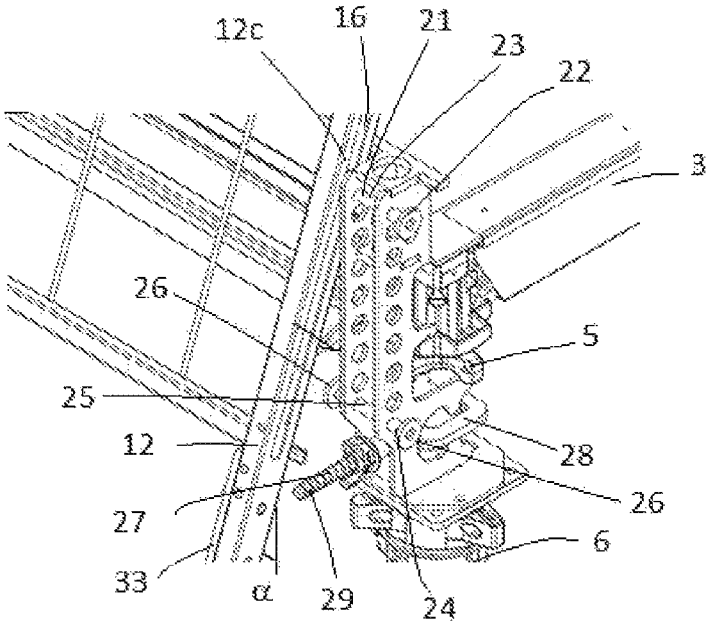
FIG. 5 shows detail B of the perimeter protection system shown in FIG. 4.
Figure 6:
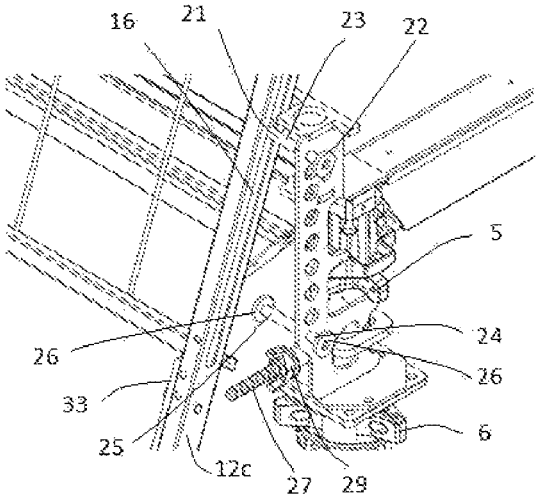
FIG. 6 shows the protection system shown in FIG. 5 in which some parts have been eliminated to favor understanding.

In the initial assembly position, the operator couples an extension 33 at each end of the profile 12 of the perimeter protection structure 11 to enable raising the perimeter structure 11 up to the intermediate position with respect to the corresponding auxiliary devices 20. After the initial assembly position, the perimeter protection structure 11 is pivoted with respect to the corresponding auxiliary devices 20, being raised with respect to the auxiliary device 20 and slid with an angle of inclination a with respect to a vertical plane, as shown in FIGS. 4, 5 and 6, between the initial assembly position and the intermediate position in which the perimeter protection structure 11 overcomes the blocking means 24. The perimeter protection structure 11 pivots with respect to the respective guiding means 23.

Once it reaches the intermediate position, the operator swings the perimeter protection structure 11 again until positioning it in a substantially vertical position. To that end, the operator acts on the extensions 33. Then, the perimeter protection structure 11 drops down with respect to the respective auxiliary device 20 until positioning the perimeter protection structure 11 in the working position shown in FIGS. 7 to 10 and 16 to 18.

Figure 8:
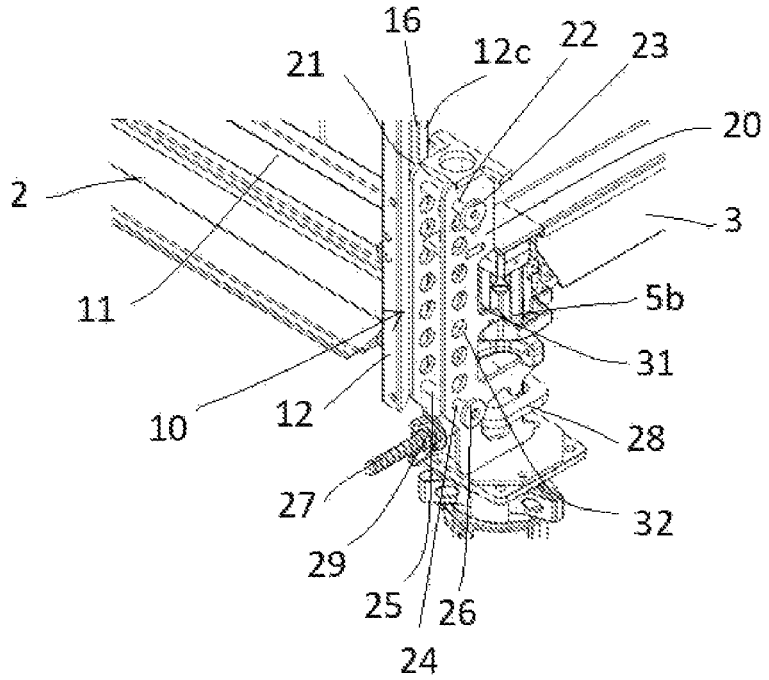
FIG. 8 shows detail C of the perimeter protection system shown in FIG. 7.
Figure 9:
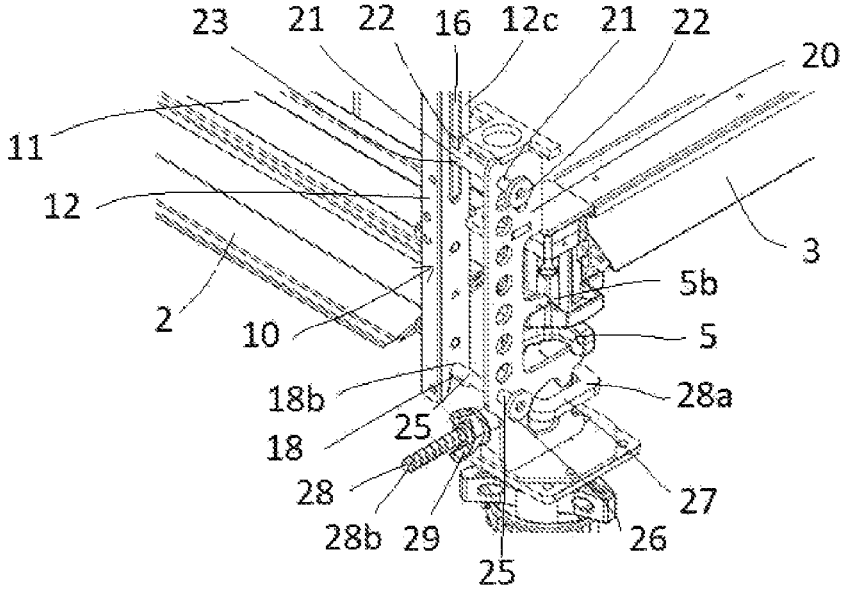
FIG. 9 shows the protection system shown in FIG. 8 in which some parts have been eliminated to favor understanding.
Figure 10:
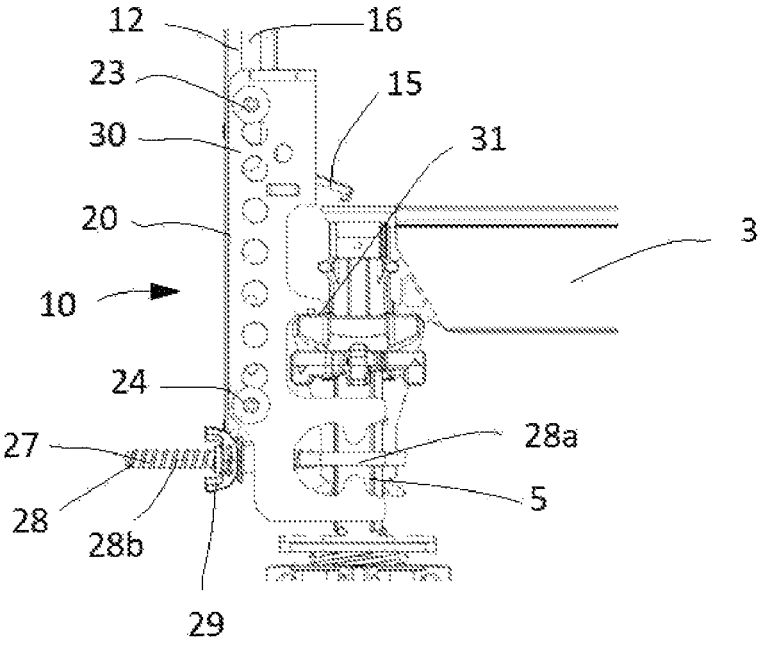
FIG. 10 shows a side view of a detail of the perimeter protection system shown in FIG. 7.
Figure 11:
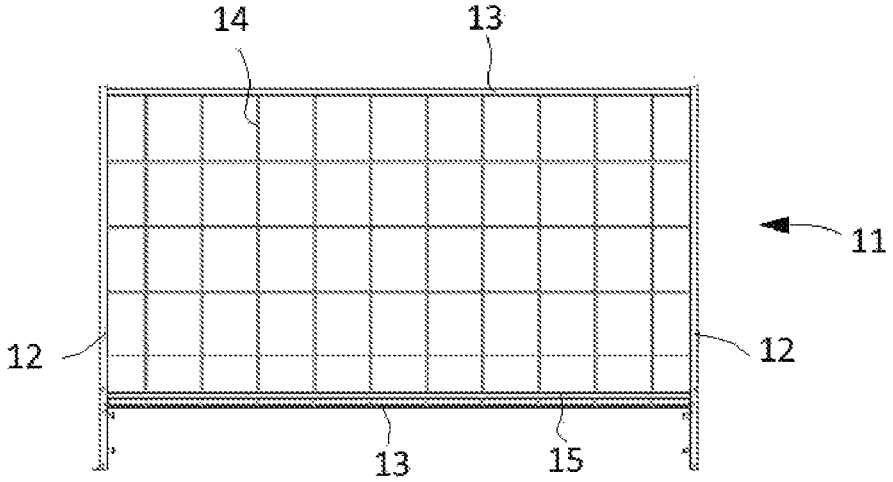
FIG. 11 shows a front view of a perimeter protection structure comprised in the perimeter protection system shown in FIG. 1.
Figure 12:
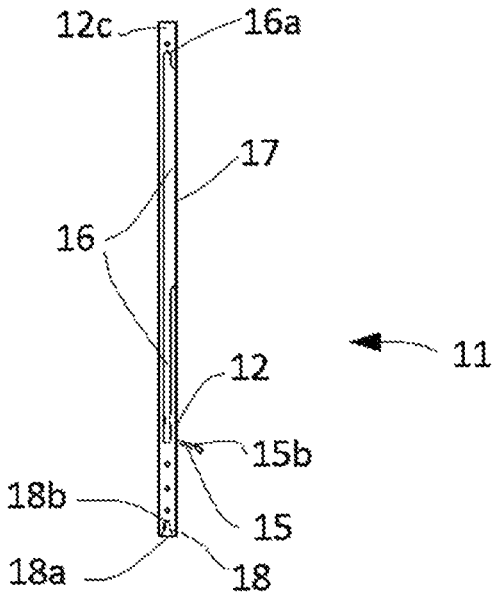
FIG. 12 shows a side view of the perimeter protection structure shown in FIG. 11.
Figure 13:
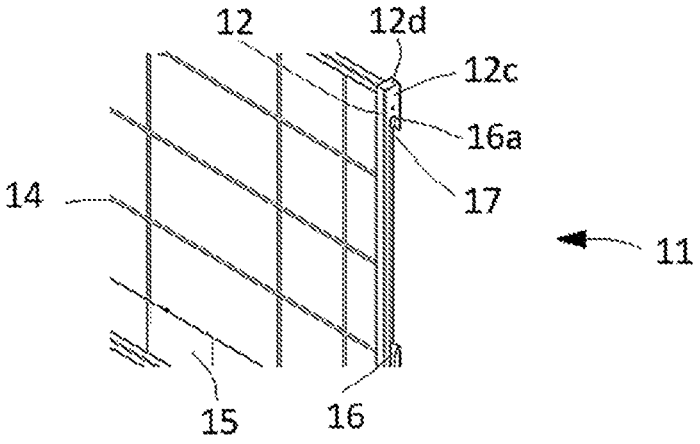
FIG. 13 shows a view of a detail of the perimeter protection structure.

As the perimeter protection structure 11 drops down, the respective blocking projection 25 of the corresponding auxiliary device 20 goes through the blocking groove 18 comprised in the perimeter protection structure 11, abutting against an end 18*b* of the blocking groove 18, which position is called the working position in which rotation and/or movement of the perimeter protection structure 11 is prevented, shown in detail in FIGS. 8 to 10. Finally, the operator releases the extensions 32 of the respective profiles 12.

For removing the perimeter protection structure 11, the operator must raise the perimeter protection structure 11 up to at least the intermediate position, then swing the perimeter protection structure 11 and raise the perimeter protection structure 11, sliding it with respect to the respective auxiliary device 20 with the angle of inclination a until positioning the perimeter protection structure 11 in the initial position.

In the initial position, the extensions 33 of the corresponding profiles 12 are released, and the perimeter protection structure 11 is raised again until the projection 21 together with the respective retaining element 22 of the guiding means 23 of the auxiliary device 20 can be released through the opening 17 of the corresponding profile 12.

Additional embodiments are disclosed in the following clauses.

Clause 1: A perimeter protection system for protecting operators against lateral falling when installing formwork panels (7) in a horizontal formwork system (1; 1'), the perimeter protection system (10) comprising at least one perimeter protection structure (11) configured for being fixed, in a working position, to the horizontal formwork system (1; 1'), and at least one auxiliary device (20) configured for being fixed to the horizontal formwork system (1; 1') and for fixing the perimeter protection structure (11) to the horizontal formwork system (1; 1'), the auxiliary device (20) comprising guiding means (23) collaborating with a guide (16) of the perimeter protection structure (11) for positioning the perimeter protection structure (11) in an initial assembly position, raising the perimeter protection structure (11) up to an intermediate position, and swinging said perimeter protection structure (11) until positioning it in the working position.

Clause 2: A perimeter protection system according to the preceding clause, wherein the guide (16) is a groove extending longitudinally in a profile (12) of the perimeter protection structure (11), the guiding means (23) comprising a projection (21) configured for going through the guide (16) and cooperating in the guided movement of the perimeter protection structure (11) with respect to the auxiliary device (20).

Clause 3: A perimeter protection system according to the preceding clause, wherein the projection (21) is arranged substantially horizontal when the auxiliary device (20) is arranged fixed to the horizontal formwork system (1; 1').

Clause 4: A perimeter protection system according to clause 2 or 3, wherein the projection (21) comprises a retaining element (22) configured for abutting against the perimeter protection structure (11), keeping the perimeter protection structure (11) coupled to the auxiliary device (20).

Clause 5: A perimeter protection system according to any of clauses 2 to 4, wherein the auxiliary device (20) comprises blocking means (24) configured for cooperating with a blocking groove (18) comprised in the perimeter protection structure (11) for blocking the movement and/or rotation of the perimeter protection structure (11) with respect to the auxiliary device (20) in the working position.

Clause 6: A perimeter protection system according to the preceding clause, wherein the blocking means (24) comprise a blocking projection (25) configured for going through the blocking groove (18) comprised in the perimeter protection structure (11) and blocking the sliding of the perimeter protection structure (11) with respect to the auxiliary device (20) when the blocking projection (25) abuts against an end (18*b*) of the blocking groove (18).

Clause 7: A perimeter protection system according to any of the preceding clauses, comprising fixing means (27) configured for fixing the auxiliary device (20) to a head (5) of the horizontal formwork system (1; 1'), the fixing means (27) comprising an anchoring hook (28) having a first hook-shaped part (28*a*) which is configured for surrounding the head (5) and a second threaded part (28*b*) configured for going through the auxiliary device (20), and a nut (29) cooperating with the second part (28*b*) for fixing the auxiliary device (20) to the horizontal formwork system (1; 1').

Clause 8: A perimeter protection system according to any of clauses 1 to 6, comprising fixing means (27') configured for fixing the auxiliary device (20) to the horizontal formwork system (1; 1'), the fixing means (27') comprising a threaded element (28') configured for going through the auxiliary device (20) and abutting against a beam (2) of the horizontal formwork system (1; 1'), and a nut (29') collaborating with the threaded element (28') for fixing the auxiliary device (20) to the beam (2).

Clause 9: A perimeter protection system according to any of the preceding clauses, comprising two auxiliary devices (20) configured for fixing the perimeter protection structure (11) to the horizontal formwork system (1; 1'), the perimeter protection structure (11) being arranged between both auxiliary devices (20).

Clause 10: A perimeter protection system according to the preceding clause, wherein the perimeter protection structure (11) comprises two profiles (12) arranged at the ends of the perimeter protection structure (11), each of which comprises a side surface (12*c*) including the corresponding guide (16).

Clause 11: A method of assembly of a perimeter protection system (10) in a horizontal formwork system (1; 1'), the perimeter protection system (10) comprising a perimeter protection structure (11) and at least one auxiliary device (20), which method of assembly comprises the following steps:

fixing the corresponding auxiliary device (20) to the horizontal formwork system (1; 1'), positioning the perimeter protection structure (11) with respect to the corresponding auxiliary device (20) in an initial assembly position, coupling guiding means (23) of the auxiliary device (20) with a guide (16) of the perimeter protection structure (11), raising the perimeter protection structure (11) up to an intermediate position, with the movement of the perimeter protection structure (11) with respect to the auxiliary device (20) being guided by means of the cooperation of the guide (16) with the guiding means (23), swinging the perimeter protection structure (11) with respect to the auxiliary device (20) until positioning it substantially vertical, and blocking the perimeter protection structure (11) in the working position through blocking means (24).

Clause 12: A method of assembly according to the preceding clause, wherein once the perimeter protection structure (11) is coupled to the corresponding auxiliary device (20), said perimeter protection structure (11) is pivoted with respect to said auxiliary device (20), being raised with respect to the auxiliary device (20) and slid with an angle of inclination ($\alpha$) between the initial assembly position and an intermediate position in which the perimeter protection structure (11) overcomes the blocking means (24).

Clause 13: A method of assembly according to clauses 11 or 12, wherein once the perimeter protection structure (11) is positioned substantially vertical after reaching the intermediate position, said perimeter protection structure (11) is dropped down until a blocking projection (25) comprised in the auxiliary device (20) goes through a blocking groove (18) comprised in the perimeter protection structure (11), abutting against an end (18*b*) of the blocking groove (18), preventing the rotation and/or movement of the perimeter protection structure (11).

Clause 14: A method of assembly according to any of clauses 11 to 13, wherein the respective auxiliary device (20) is fixed to the horizontal formwork system (1; 1') through fixing means (27) comprising an anchoring hook (28) the end of which is fixed surrounding a head (5) of the horizontal formwork system (1; 1') and goes through the auxiliary device (20), and a nut (29) which is screwed to the anchoring hook (28) until it abuts against the auxiliary device (20).

Clause 15: A method of assembly according to any of the clauses 11 to 13, wherein the respective auxiliary device (20) is fixed to the horizontal formwork system (1; 1') through fixing means (27') comprising a threaded element (28') going through the auxiliary device (20) until abutting against a beam (2) of the horizontal formwork system (1; 1'), and a nut (29') which is screwed on until it abuts against the auxiliary device (20).

What is claimed is:

1. A perimeter protection system for use in a horizontal formwork system, the perimeter protection system comprising:

a perimeter protection structure that includes a first elongate profile forming a part of a railing of the perimeter protection structure, the first elongate profile having a guide that extends along a length of a first portion of the first elongate profile and a blocking groove that extends along a length of a second portion of the first elongate profile, the guide having spaced-apart first and second ends, the first end being located in a first end section of the first elongate profile, the blocking groove being located in a second end section of the first elongate profile located opposite the first end section, the blocking groove including an open end located at an end of the second end section and an at least partially closed end spaced-apart from the open end;

a first auxiliary device attachable to a part of the horizontal formwork system, the first auxiliary device including a longitudinal body, a guide projection and a blocking projection, the blocking projection being spaced-apart from the guide projection, the guide projection being configured to be guided within the guide between the first and second ends, the blocking projection being configured to be guided within the blocking groove between the open end and closed end;

wherein the perimeter protection structure is moveable between an initial assembly position, an intermediate position and a working position, in the initial assembly position the guide projection is located in the guide abutting the first end and the blocking projection resides outside the blocking groove, in the initial assembly position the perimeter protection structure is rotatable with respect to the first auxiliary device to assume the intermediate position, in the intermediate position the guide projection is located in the guide and the blocking projection resides outside the blocking groove, when in the working position the guide projection is located in the guide and the blocking projection is located in the blocking groove abutting the closed end, in the working position the perimeter protection device is not rotatable with respect to the first auxiliary device.

2. The perimeter protection system according to claim 1, wherein the first elongate profile is vertically oriented in both the initial assembly position and in the working position.

3. The perimeter protection system according to claim 1, wherein the guide projection is arranged substantially horizontal when the first auxiliary device is arranged fixed to the horizontal formwork system.

4. The perimeter protection system according to claim 1, wherein the guide projection includes a first retaining element configured for residing inside the guide and abutting against an inner surface of the first guide to keep the first elongate profile coupled to the first auxiliary device.

5. The perimeter protection system according to claim 1, wherein the horizontal formwork system includes a first longitudinal beam fixed to a first head of a first prop, the perimeter protection system further comprising a fixing assembly that is configured to fix the first auxiliary device to the first head, the fixing assembly including a hook-shaped part that is configured to at least partially surround the first head, a threaded part attached to the hook-shaped part is configured to pass through the longitudinal body of the first auxiliary device, and a nut that is configured to be threaded onto the threaded part to fix the first auxiliary device to the first head.

6. The perimeter protection system according to claim 5, wherein the longitudinal body of the first auxiliary device includes a protruding tab that is configured to reside inside a groove in the first head to prevent a rotation of the first auxiliary device with respect to the first head.

7. The perimeter protection system according to claim 1, wherein the horizontal formwork system includes a first longitudinal beam attached to a first head of a first prop, the perimeter protection system further comprising a fixing assembly that is configured to fix the first auxiliary device to the first longitudinal beam, the fixing assembly including a threaded element configured to pass through the longitudinal body of the first auxiliary device to abut against a side of the first longitudinal beam, and a nut that cooperates with the threaded element to fix the first auxiliary device to the first longitudinal beam.

8. The perimeter protection system according to claim 7, wherein the longitudinal body of the first auxiliary device includes a protruding tab that is configured to reside inside a groove in the first longitudinal beam to prevent a rotation of the first auxiliary device with respect to the first longitudinal beam.

9. The perimeter protection assembly according to claim 1, wherein the guide and blocking groove are longitudinal aligned.

10. The perimeter protection system according to claim 1, wherein the perimeter protection structure further includes:

a second elongate profile that forms a part of the railing of the perimeter protection structure, the second elongate profile having a guide that extends along a length of a first portion of the second elongate profile and a blocking groove that extends along a length of a second portion of the second elongate profile, the guide of the second elongate profile having spaced-apart first and second ends, the first end of the second elongate profile being located in a first end section of the second elongate profile, the blocking groove being located in a second end section of the second elongate profile located opposite the first end section of the second elongate profile, the blocking groove of the second elongate profile including an open end located at an end of the second end section and an at least partially closed end spaced-apart from the open end of the second elongate profile; and a second auxiliary device attachable to a part of the horizontal formwork system, the second auxiliary device including a longitudinal body, a guide projection and a blocking projection spaced-apart from the guide projection, the guide projection of the second auxiliary device being configured to be guided within the guide of the second elongate profile between the first and second ends of the second elongate profile, the blocking projection of the second auxiliary device being configured to be guided within the blocking groove of the second elongate profile between the open end and at least partially closed end of the second elongate profile;

in the initial assembly position the guide projection of the second auxiliary device is located in the guide of the second elongate profile abutting the first end and the blocking projection of the second auxiliary device resides outside the blocking groove of the second elongate profile, in the initial assembly position the perimeter protection structure is rotatable with respect to the second auxiliary device to assume the intermediate position, in the intermediate position the guide projection of the second auxiliary device is located in the guide of the second elongate profile and the blocking projection of the second auxiliary device resides outside the blocking groove of the second elongate profile, when in the working position the guide projection of the second auxiliary device is located in the guide of the second elongate profile between the first and second ends and the blocking projection of the second auxiliary device is located in the blocking groove of the second elongate profile abutting the at least partially closed end, in the working position the perimeter protection device is not rotatable with respect to the second auxiliary device.

* * * * *